US008180249B2

(12) United States Patent
Okaji

(10) Patent No.: US 8,180,249 B2
(45) Date of Patent: May 15, 2012

(54) IMAGE FORMING APPARATUS

(75) Inventor: Hiroyuki Okaji, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 806 days.

(21) Appl. No.: 12/267,979

(22) Filed: Nov. 10, 2008

(65) Prior Publication Data

US 2009/0129814 A1 May 21, 2009

(30) Foreign Application Priority Data

Nov. 15, 2007 (JP) ..... 2007-296225
Sep. 22, 2008 (JP) ..... 2008-242265

(51) Int. Cl.
*G03G 15/00* (2006.01)

(52) U.S. Cl. ..... 399/110; 399/119; 399/116; 399/117

(58) Field of Classification Search ..... 399/110, 399/111, 116, 117, 119
See application file for complete search history.

(56) References Cited

U.S. PATENT DOCUMENTS

| | | | | |
|---|---|---|---|---|
| 4,984,024 | A | 1/1991 | Ohkaji et al. | |
| 5,189,479 | A | 2/1993 | Matsuda et al. | |
| 5,719,684 | A | 2/1998 | Ohkaji et al. | |
| 5,802,427 | A * | 9/1998 | Sawada et al. | 399/122 |
| 5,930,564 | A | 7/1999 | Ookaji | |
| 6,085,062 | A | 7/2000 | Mizuishi et al. | |
| 6,128,449 | A | 10/2000 | Zenba et al. | |
| 6,144,811 | A | 11/2000 | Ohori et al. | |
| 6,160,969 | A | 12/2000 | Ishigaki et al. | |
| 6,484,003 | B2 * | 11/2002 | Tokutake et al. | 399/110 |
| 6,628,903 | B1 | 9/2003 | Ohori et al. | |
| 6,898,383 | B2 | 5/2005 | Ohori et al. | |
| 2007/0110486 | A1 | 5/2007 | Okaji | |
| 2007/0116494 | A1 | 5/2007 | Uno et al. | |
| 2007/0280742 | A1 | 12/2007 | Matsumoto et al. | |
| 2008/0063434 | A1 | 3/2008 | Uno et al. | |
| 2008/0175628 | A1 | 7/2008 | Kita et al. | |

FOREIGN PATENT DOCUMENTS

| | | |
|---|---|---|
| JP | 11-30942 | 2/1999 |
| JP | 2006-171534 | 6/2006 |
| JP | 2007-133021 | 5/2007 |

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes an enclosure including a first opening provided at a front side thereof, a second opening provided at a left side thereof, and a third opening provided at a right side thereof. The enclosure further includes an image bearing member to bear a latent image on the surface thereof; an image forming unit including the image bearing member and detachably mountable from the first opening; an exposure unit to expose the image bearing member to form the latent image on the surface of the image bearing member and detachably mountable from either the second or the third opening that is opposite the opening from which an intermediate transfer unit is detachably mountable; the intermediate transfer unit to transfer the toner image and detachably mountable from either the second or the third opening that is opposite the opening from which the exposure unit is detachably mountable.

20 Claims, 7 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application Nos. 2007-296225, filed on Nov. 15, 2007, and No. 2008-242265, filed on Sep. 22, 2008 in the Japan Patent Office, the entire contents of each of which are hereby incorporated herein by reference.

BACKGROUND OF THE INVENTION

1. Field of the Invention

Exemplary aspects of the present invention generally relate to an image forming apparatus, and more particularly, to an image forming apparatus including an image forming unit that includes a plurality of image bearing members, a sheet feeder, an exposure unit, an intermediate transfer belt, and a toner supply unit.

2. Description of the Background Art

There are image forming apparatuses that include an image forming unit including a plurality of image bearing members, a sheet feeder, an exposure unit, an intermediate transfer belt, and a toner supply unit.

In such image forming apparatuses in general, in order to facilitate maintenance and replacement of consumables, each component is configured to be detachably mountable relative to an image forming apparatus main structure, examples of which are disclosed in JP-11-030942-A and JP-2006-171534-A.

In JP-11-030942-A, a front frame and an intermediate frame that supports a process cartridge are coaxially disposed in an opening of a hub portion of an immovable main body frame, so that a supporting point of rotation of the front frame and the intermediate frame is the same. Accordingly, the front frame can be opened and/or closed smoothly without interference from components.

With this configuration, when the front cover is opened and the intermediate frame is turned, the process cartridge can be attached/detached with ease. Further, when the front frame and the intermediate frame are linked so as to operate together, other components, such as a color developer, a monochrome developer, and so forth, can be replaced without removing the process cartridge, thus facilitating maintenance and replacement of consumables.

In JP-2006-171534-A, an image forming apparatus includes a sheet feeder, an exposure unit, an image forming unit, an intermediate transfer unit, a fixing unit, and a sheet tray are provided, in that order, from substantially the bottom of the image forming apparatus. In this particular image forming apparatus, a sheet transport path is substantially vertical. When a rotary frame that exposes the sheet transport path is opened, the intermediate transfer unit becomes detachable from the image forming apparatus in the opening direction of the rotary frame at an angle of 15 degrees both upward and downward relative to the horizontal direction of the image forming apparatus.

However, since the structure disclosed in JP-11-030942-A includes the intermediate frame, the cost of the image forming apparatus increases. Further, in the image forming apparatus disclosed in JP-2006-171534-A, a single path is used to guide a plurality of components to be detached from the image forming apparatus, thus requiring that the components need to be attached or detached in a certain order.

In other words, when the components disposed at substantially the back of the image forming apparatus in the removing direction need to be replaced, the components disposed at substantially the front of the image forming apparatus need to be removed temporarily in order to provide access to the components at the back of the image forming apparatus, thereby complicating replacement.

SUMMARY OF THE INVENTION

Illustrative embodiments of the present invention provide an image forming apparatus in which different mounting positions for a sheet cassette, an image forming unit, an exposure unit, and an intermediate transfer unit enable these units to be serviced more easily.

According to one preferred embodiment, the image forming apparatus includes an enclosure. The enclosure includes a first opening provided at a front side thereof, a second opening provided at a left side thereof, and a third opening provided at a right side thereof. The enclosure further includes an image bearing member, an image forming unit, an exposure unit, a developing device, an intermediate transfer unit, a toner supply unit, and a sheet feed unit.

The image bearing member is configured to bear a latent image on the surface thereof. The image forming unit includes the image bearing member and is configured to be detachably mountable from the first opening. The exposure unit is configured to expose the image bearing member in the image forming unit to form the latent image on the surface of the image bearing member and detachably mountable from either the second opening or the third opening that is opposite the opening from which an intermediate transfer unit is detachably mountable. The developing device is configured to develop the latent image with toner to form a toner image on the image bearing member. The intermediate transfer unit is configured to transfer the toner image on the image bearing member and detachably mountable from either the second opening or the third opening that is opposite the opening from which the exposure unit is detachably mountable. The toner supply unit includes a toner cartridge replaceable from the first opening and is configured to supply toner to the developing device. The sheet feed unit is configured to be supplied with transfer sheets from the first opening.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
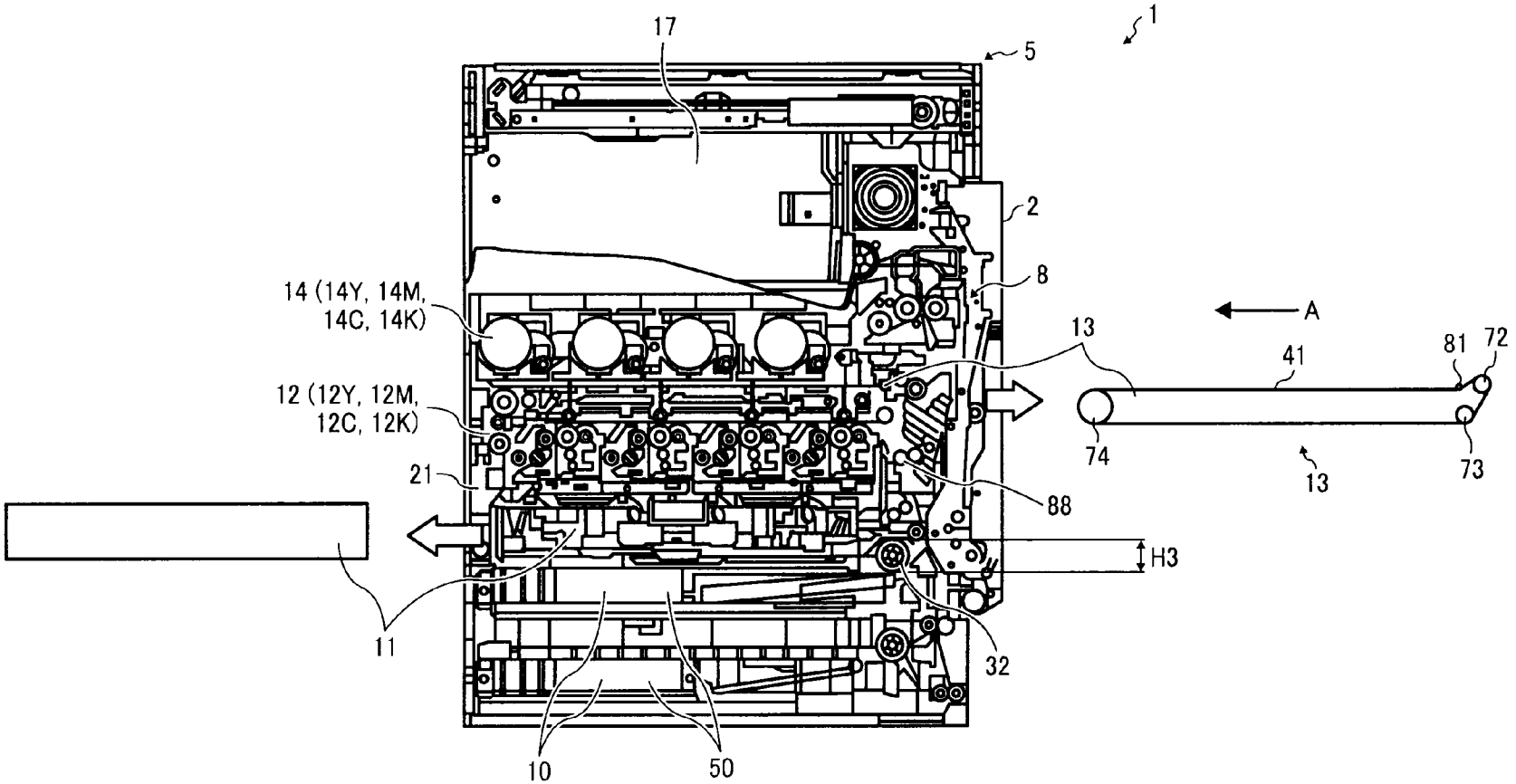
FIG. 1 is a schematic diagram illustrating a color printer as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus, for example, a color printer, according to an illustrative embodiment of the present invention is described.

FIG. 1 is a schematic diagram illustrating a color printer (hereinafter referred to as an image forming apparatus) as one example of an image forming apparatus for producing color images.

In FIG. 1, the image forming apparatus 1 according to the illustrative embodiment is a tandem-type full-color printer using an intermediate transfer method. It is to be noted that the image forming apparatus is not limited to a printer, but may be a copier or a facsimile machine, or a multi-functional system including any combination thereof.

Further, the transfer method employed in the image forming apparatus is not limited to the intermediate transfer method. The transfer method may include, but not limited to, a direct transfer method. The image forming apparatus is not limited to a tandem-type, but may employ other image forming methods and different number of colors.

According to the illustrative embodiment, the image forming apparatus includes, from the bottom thereof, a sheet feeder 10, an exposure device 11, an image forming unit 12, an intermediate transfer unit 13, and toner cartridges 14Y, 14M, 14C, and 14K. However, alternatively, the position of the exposure unit 10 can be switched with the intermediate transfer unit 13 so that the exposure unit 10 can expose the image forming unit 12 from substantially above.

In the image forming apparatus 1, a transfer sheet after being fixed is discharged inside the image forming apparatus.

The image forming apparatus 1 can form an image based on an image signal corresponding to image information received from external devices such as a personal computer (PC) or the like. An image can be formed on a normal sheet used for general copying, a relatively thick sheet such as an OHP sheet, a postcard, a card, an envelope, and so forth.

The image forming apparatus 1 includes an enclosure 2. The enclosure 2 includes from the bottom thereof the sheet feeder 10 including a plurality of sheet cassettes 50; the exposure device 11; the image forming unit 12 including image bearing members (hereinafter referred to as photoreceptor drums) 12Y, 12M, 12C, and 12K corresponding to colors of yellow, magenta, cyan, and black, respectively; the intermediate transfer unit 13; and the toner cartridges 14Y, 14M, 14C, and 14K, each of which stores a respective color of toner, yellow, magenta, cyan, and black.

It is to be noted that reference characters Y, M, C, and K denote colors yellow, magenta, cyan, and black, respectively.

In FIG. 1, the image forming apparatus 1 includes also a document reader 5, a fixing unit 8, a sheet discharge unit 17, and so forth.

The sheet feeder 10 includes the sheet cassettes 50 stacked on one another and each including a sheet feed roller 32. According to the illustrative embodiment, the sheet feeder 10 includes a plurality of the sheet cassettes 50. Alternatively, the sheet feeder 10 may include a single sheet cassette 50.

The exposure unit 11 includes light sources (not illustrated), an optical system (not illustrated), and so forth, and illuminates the photoreceptor drums 12Y, 12M, 12C, and 12K of the image forming unit 12. A description of the exposure unit 11 will be provided later with reference to FIG. 3.

The intermediate transfer unit 13 includes an intermediate transfer belt 41 wound around a drive roller 72, and stretch rollers 73 and 74.

The transfer sheets stored in the sheet feeders 10, the photoreceptor drums 12Y, 12M, 12C, and 12K of the image forming unit 12, and toner cartridges 14Y, 14M, 14C, and 14K are consumables and can be replaced when the predetermined amount is consumed.

According to the illustrative embodiment, the intermediate transfer unit 13 is detachably mountable from the right side of the enclosure 2 in FIG. 1, in a direction perpendicular to a replacement direction of the consumables. By contrast, the exposure unit 11 is detachably mountable from the left side of the enclosure 2. The detailed description thereof will be provided later.

According to the illustrative embodiment, the four image bearing members, that is, the photoreceptor drums 12Y, 12M, 12C, and 12K are arranged in this order. However, arrangement is not limited to yellow, magenta, cyan, and black.

Figure 9:
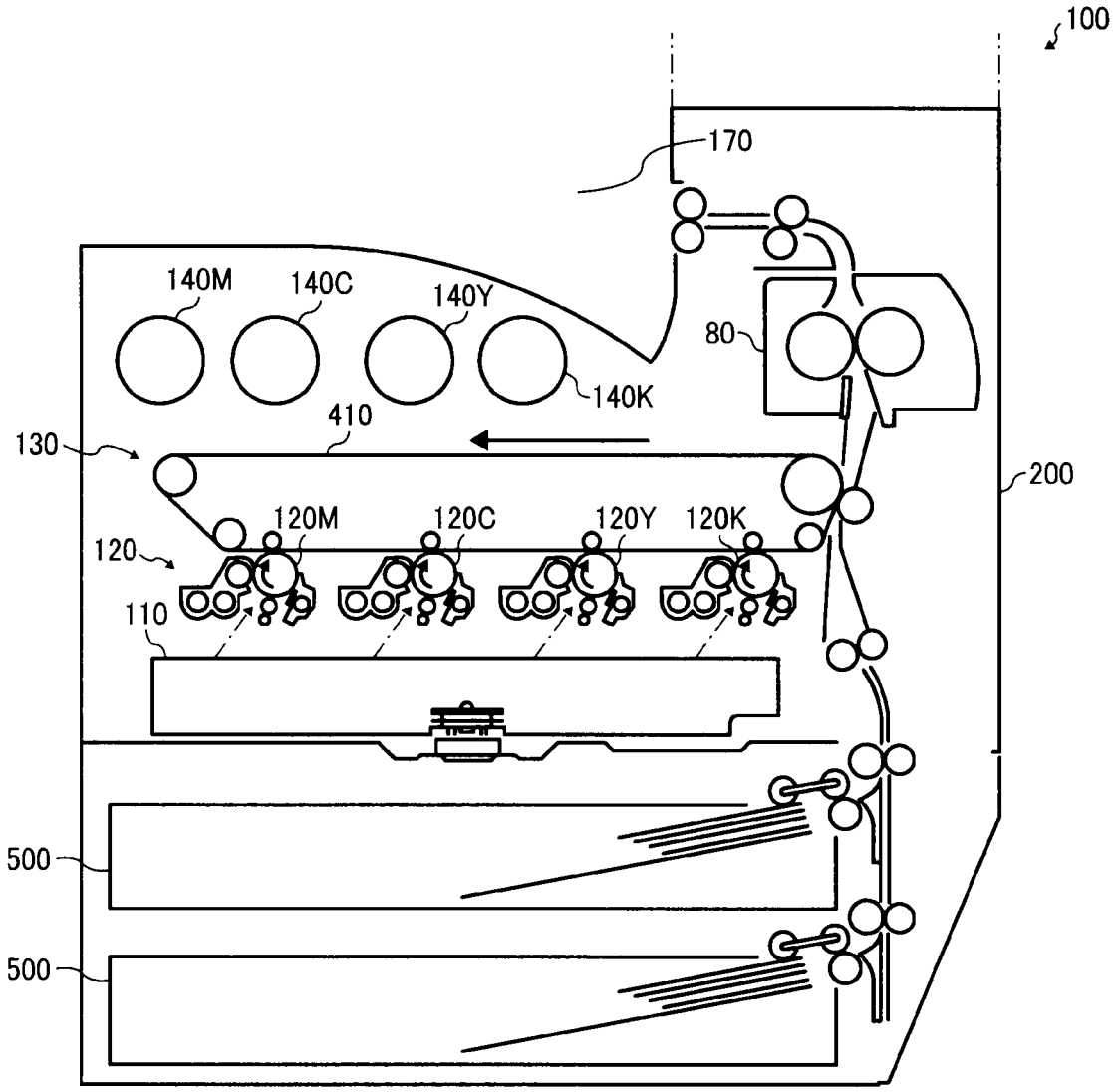
FIG. 9 RELATED ART
FIG. 9 is a schematic cross-sectional view illustrating a related art color printer.

Referring now to FIG. 9, there is provided a schematic diagram illustrating a related-art color printer to compare with the image forming apparatus 1 of the illustrative embodiment. The color printer 100 illustrated in FIG. 9 is also a tandem-type full-color printer using the intermediate transfer method.

In the related art color printer 100, in substantially the center of the enclosure 200, an intermediate transfer unit 130 including an intermediate transfer belt 410 wound around a plurality of rollers is provided.

Substantially below the intermediate transfer unit 130, the related art color printer 100 includes sheet cassettes 500, an exposure unit 110, and image forming unit 120 including four photoreceptor drums 120M, 120C, 120Y, and 120K serving as image bearing members corresponding to colors magenta, cyan, yellow, and black, respectively.

In the color printer 100 illustrated in FIG. 9, a single path guides a plurality of components such as the intermediate transfer unit 130 and the exposure unit 110, for example, when these components need to be detached and mounted. In particular, these components are detachably mountable from the left side in FIG. 9.

Consequently, as described above, these components are detached from and attached to the enclosure 200 in a particular order. When the component disposed in substantially the back of the enclosure 200 needs to be replaced, the component disposed in the front needs to be temporarily removed outside the enclosure 200.

By contrast, according to the illustrative embodiment, the sheet cassettes 50 are configured to be pulled out from the front side of the enclosure 2. The transfer sheet can be supplied to the sheet cassettes 50 while the sheet cassettes 50 are pulled out to the front side of the enclosure 2, that is, to the front side in FIG. 1.

Therefore, the enclosure 2 includes an opening from which the sheet cassettes 50 can be pulled out. As the sheet cassettes 50 are installed in the sheet feeder 10, a cover member provided to each of the sheet cassettes 50 covers the opening of the enclosure 2.

Each of the photoreceptor drums 12Y, 12M, 12C, and 12K of the image forming unit 12 is provided as a process unit. In addition to the photoreceptor drums 12Y, 12M, 12C, and 12K, each of the process unit includes a charger, a developing device, a cleaner, a charge neutralizer, and so forth. Each of the process unit is also detachably mountable and also replaceable from the front side of the enclosure 2, that is, from the front of FIG. 1.

The toner cartridges 14Y, 14M, 14C, and 14K are detachably mountable and replaceable from the front side of the enclosure 2 as well.

By contrast, the exposure unit 11 and the intermediate transfer unit 13 are detachably mountable in different directions from the above-described installation direction of the consumables.

In other words, the exposure unit 11 is configured to be detachably mountable from one of the sides of the enclosure 2, that is, from the left side of the enclosure 2 in FIG. 1 according to the illustrative embodiment. Accordingly, the exposure unit 11 can be pulled out from the enclosure 2 upon repair or maintenance with ease.

The intermediate transfer unit 13 is detachably mountable relative to the enclosure 2 from the right side of the enclosure 2 which is the opposite side from which the exposure 11 is detachably mountable so that the intermediate transfer unit 13 can be pulled out upon repair or maintenance with ease.

Figure 2:
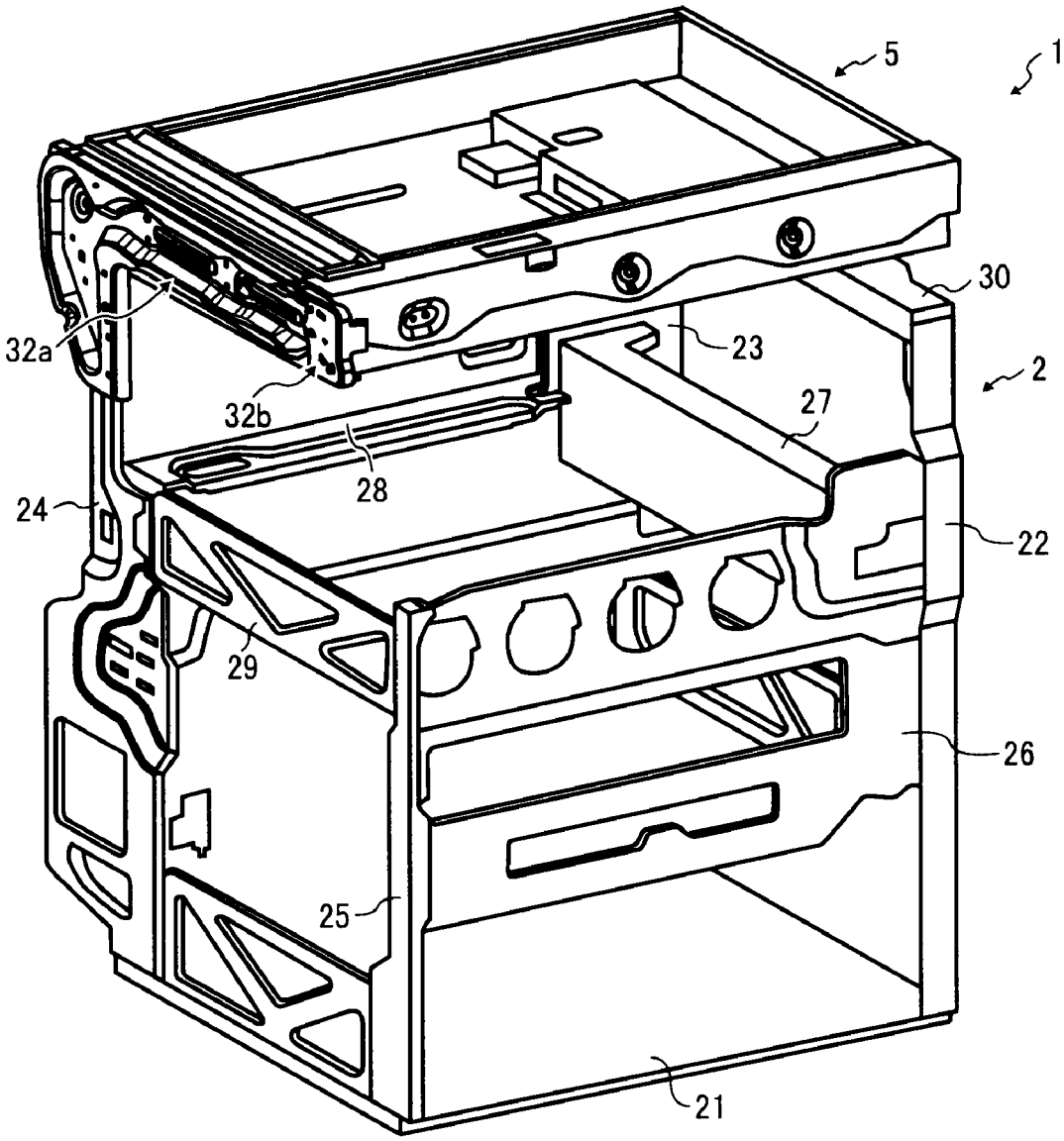
FIG. 2 is a schematic perspective view illustrating an example of an enclosure of the image forming apparatus of FIG. 1 according to an illustrative embodiment of the present invention.

Referring now to FIG. 2, there is provided a perspective view illustrating an example configuration of the enclosure 2 of the image forming apparatus 1 illustrated in FIG. 1, according to the illustrative embodiment FIG. 2 illustrates one example of the enclosure 2 that may realize the above-described the detachment and attachment operation. It is to be noted that the same reference numerals used in FIG. 1 are provided to the similar or the same constituent elements in FIG. 2 when discrimination therebetween is not required.

The enclosure 2 includes a rectangular bottom plate 21 or a bottom frame (hereinafter referred to as a base portion), columns 22, 23, 24, and 25, side plates 26, 27, 28, and 29, two scanner support members 30 (a visible portion from the front is illustrated in FIG. 2), a cantilevered scanner support member 32*a*, and an adjust member 32*b*.

Each of the columns 22, 23, 24, and 25 is vertically disposed at each corner of the base portion 21. The side plates 26, 27, 28, and 29 are provided between the columns 22, 23, 24, and 25. The three columns 22, 23, and 24 are relatively long and configured to support substantially the bottom portion of the scanner 5 that is provided at the top of the enclosure 2.

The scanner support members 30 are provided horizontally and substantially above the columns 22, 23, and 24.

The cantilevered scanner support member 32*a* projects horizontally from the upper end portion of the column 24 toward the column 25 which is relatively shorter than other columns 22 through 24.

The beams 22 through 25, the scanner support members 30, the cantilevered scanner support member 32*a*, and the adjust member 32*b* constitute the enclosure 2. The scanner 5 is supported by the scanner support members 30 and the cantilevered scanner support member 32*a*.

Figure 3:
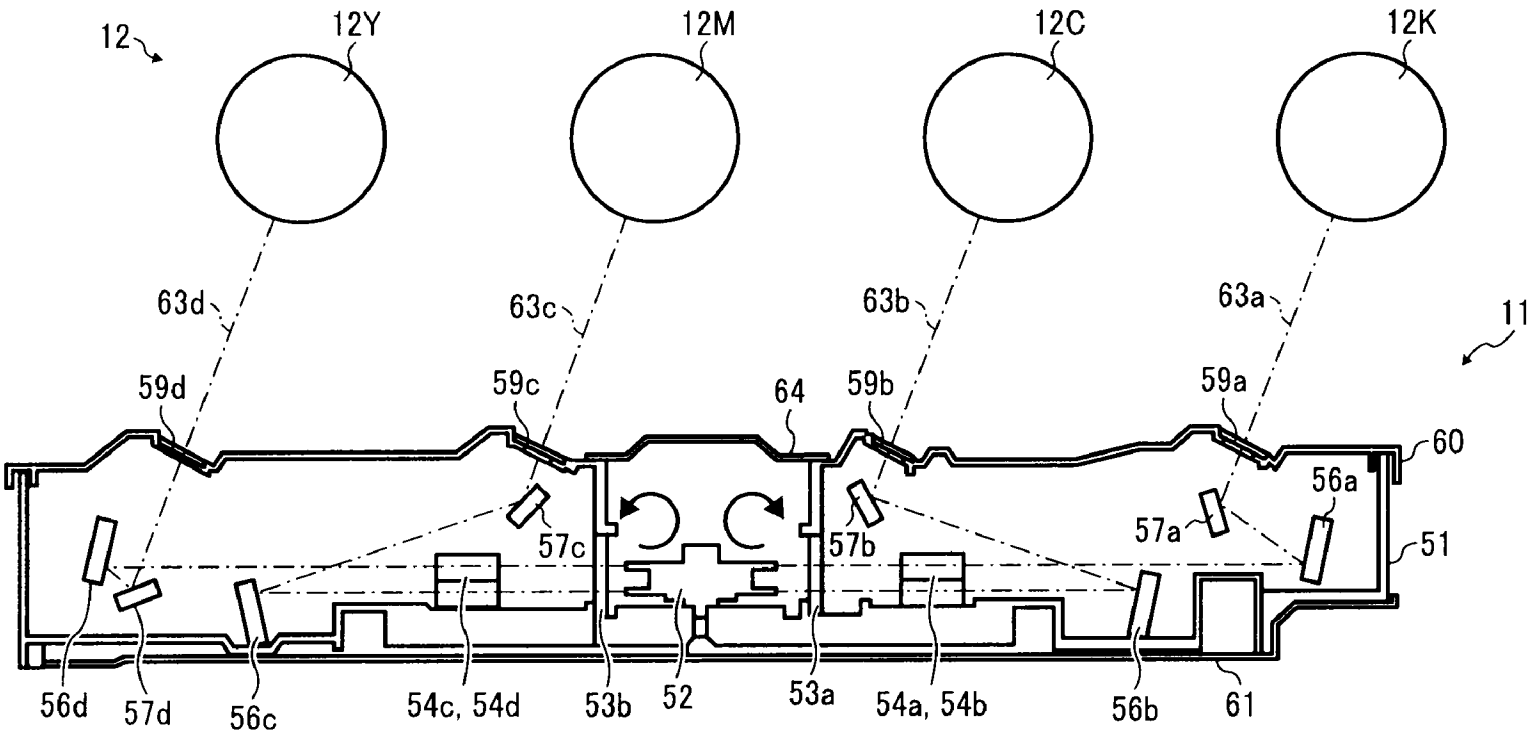
FIG. 3 is a cross-sectional view illustrating an exposure unit in the image forming apparatus according to an illustrative embodiment of the present invention.

Referring now to FIG. 3, there is provided a cross sectional view illustrating the exposure unit 11 of the image forming apparatus 1 illustrated in FIG. 1.

The exposure unit 11 includes four light sources (not illustrated) including laser diodes (LD) dedicated for each color yellow, magenta, cyan and black, an optical collimate system that collimates light fluxes emitted from the optical sources, and an optical system including a polygon scanner or a rotary deflector 52 equipped with a polygon mirror and a polygon motor, lenses such as f-θ lenses for scanning and imaging, correction lenses, mirrors, and so forth.

In particular, as illustrated in FIG. 3, the exposure unit 11 includes an optical housing 51; the polygon scanner 52 including the polygon mirror and the polygon motor; a pair of soundproof glasses 53*a* and 53*b*; f-θ lenses or scan lenses 54*a*, 54*b*, 54*c*, and 54*d* for scanning and imaging disposed in the light paths from the light sources; a long lens, not illustrated, disposed corresponding to the f-θ lenses 54*a*, 54*b*, 54*c*, and 54*d*; deflection mirrors including first mirrors 56*a*, 56*b*, 56*c*, and 56*d*, second mirrors 57*a*, 57*b*, 57*c*, and 57*d*, and third mirrors, not illustrated; dust proof glasses 59*a*, 59*b*, 59*c*, and 59*d*; an upper cover 60; a bottom cover 61; light paths 63*a*, 63*b*, 63*c*, and 63*d*, each of which directs optical beams to the respective photoreceptor drums 12*a*, 12*b*, 12*c*, and 12*d*; and a second cover 64.

Substantially below the image forming unit 12, the exposure unit 11 is provided. It is to be noted that the exposure unit 11 according to the illustrative embodiment employs a known exposure configuration. Thus, a detailed description and an illustration are omitted herein.

The polygon scanner 52 is disposed in substantially the center of the exposure unit 11. The polygon scanner 52 is configured to deflect and scan the light fluxes from the four light sources (not illustrated) onto the four respective photoreceptor drums 12Y, 12M, 12C, and 12K, thereby writing latent images thereon.

The polygon scanner 52 is fixed to the optical housing 51. Around the periphery of the mounting portion of the polygon scanner 52, walls are provided. However, in the light paths 63*a*, 63*b*, 63*c*, and 63*d* for directing incident beams from the light sources and scan beams reflected by the deflection mirrors, the dust proof glasses 59*a*, 59*b*, 59*c*, and 59*d* are disposed so that the f-θ lenses or the scan lenses can deflect and scan properly the desired light beams.

The upper cover 60 and the bottom cover 61 separate the inside the exposure unit 11 from outside, while connecting to the installation space for the polygon scanner 52 in the optical housing 51. The space formed by the upper cover 60 and the bottom cover 61 is different from a space in which the optical elements are disposed so that relatively hot airflow generated and dispersed by the deflection mirrors of the polygon scanner 52 is prevented from striking directly the optical elements and deteriorating optical characteristics thereof.

It is to be noted that the space formed between the upper cover 60 and the bottom cover 61 is less likely to cause restriction on arrangement of the optical devices disposed in the exposure unit 11, thereby providing greater flexibility in the arrangement of the optical devices.

For example, it is possible to secure a space in the direction perpendicular to an optical axis of the scan lens and in the upper portion of the scan lens and provide a space larger than the installation portion of the polygon scanner 52 of the optical housing 51. Accordingly, it is possible to prevent a rise in temperature of the polygon scanner 52.

Figure 4:
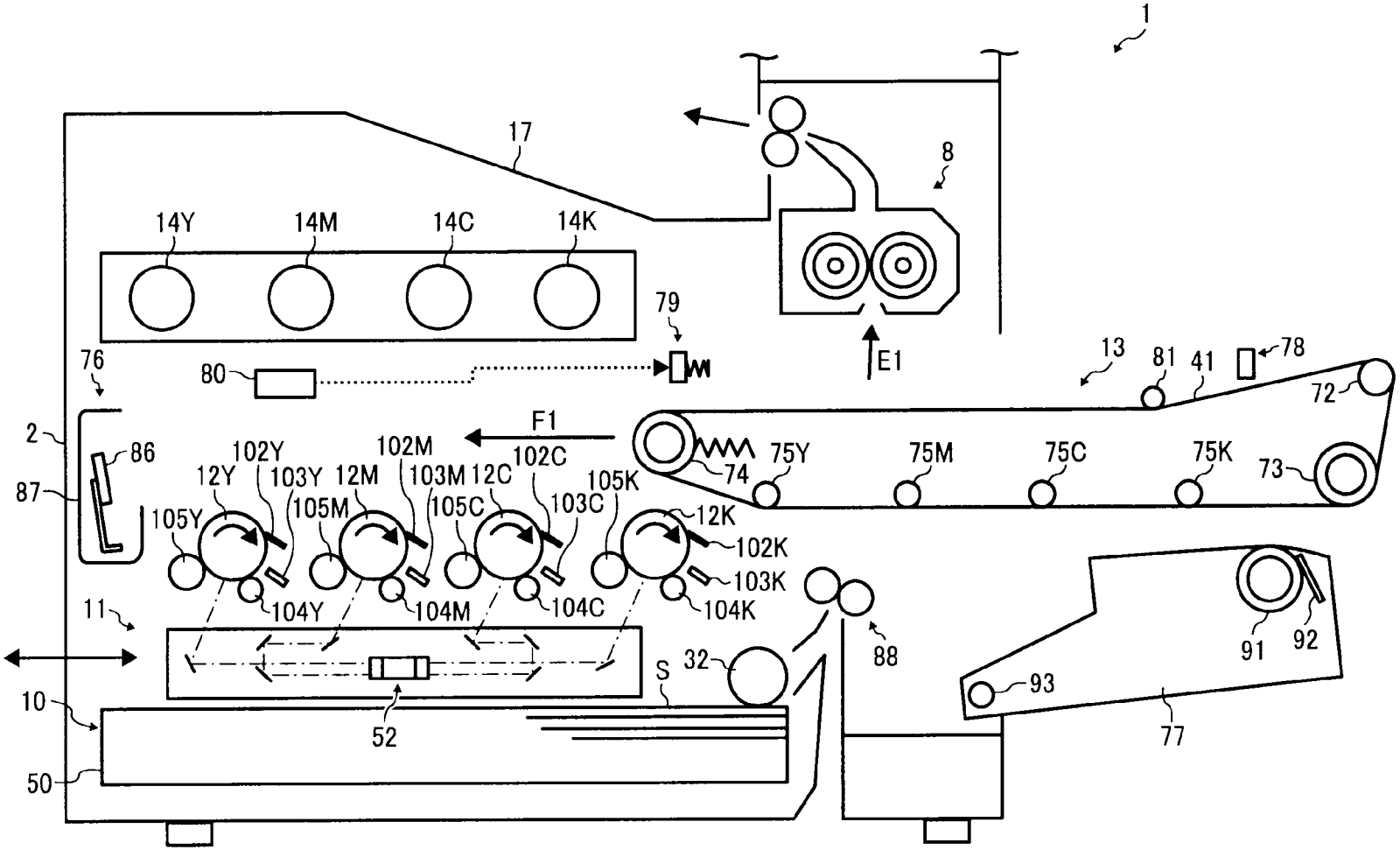
FIG. 4 is a schematic diagram conceptually illustrating a mounting structure of the exposure unit and an intermediate transfer unit of the image forming apparatus according to an illustrative embodiment of the present invention.

Referring now to FIG. 4, there is provided a schematic diagram conceptually illustrating mounting of the exposure unit 11 and the intermediate transfer unit 13 in the image forming apparatus 1 of FIG. 1, according to the illustrative embodiment.

Although the sheet feeder 10 includes two sheet cassettes 50 in FIG. 1, the sheet feeder 10 illustrated in FIG. 4 is provided with a single sheet cassette 50. According to the present invention, the number of sheet cassettes is not limited to two. It is to be noted that the number of sheet cassettes does not change the effect attained by the present invention. Thus, a similar if not the same effect attained by the configuration illustrated in FIG. 1 can be attained by the configuration illustrated in FIG. 4.

The photoreceptor drums 12Y, 12M, 12C, and 12K are rotatably supported by a frame, not illustrated, of the enclosure 2 and arranged next to each other in this order from the left along the moving direction of the intermediate transfer belt 41 serving as a second image bearing member.

The photoreceptor drums 12Y, 12M, 12C, and 12K are disposed substantially below the outer surface of the intermediate transfer belt 41, which is itself disposed in substantially the center of the enclosure 2. In other words, the photoreceptor drums 12Y, 12M, 12C, and 12K are disposed facing the surface of the intermediate transfer belt 41 on which an image is formed during image formation.

The intermediate transfer belt 41 is wound around the drive roller 72 and the stretch rollers 73 and 74, and is rotatable in the direction of arrow A while contacting the photoreceptor drums 12Y, 12M, 12C, and 12K.

Inside the loop formed by the intermediate transfer belt 41, primary transfer rollers 75Y, 75M, 75C, and 75K are provided facing the photoreceptor drums 12Y, 12M, 12C, and 12K, respectively.

Toner images of different colors formed on the primary transfer rollers 75Y, 75M, 75C, and 75K are overlappingly transferred onto the intermediate transfer belt 41 traveling in the direction of arrow A at the same location, thereby forming a composite toner image thereon. The composite toner image is subsequently transferred onto the transfer sheet S serving as the recording medium.

The bottom portion of the intermediate transfer belt 41 facing the photoreceptor drums 12Y, 12M, 12C, and 12K serves as the primary transfer portion where the toner images on the photoreceptor drums 12Y, 12M, 12C, and 12K are primarily transferred.

The toner images formed on the photoreceptor drums 12Y, 12M, 12C, and 12K are overlappingly transferred onto the intermediate transfer belt 41 at the same location, such that, while the intermediate transfer belt 41 travels in the direction of arrow A, a predetermined voltage is applied by the primary transfer rollers 75Y, 75M, 75C, and 75K facing the photoreceptor drums 12Y, 12M, 12C, and 12K, respectively, via the intermediate transfer belt 41.

The voltage is applied at a different timing from upstream to downstream in the direction of arrow A so that the toner images formed on the photoreceptor drums 12Y, 12M, 12C, and 12K are overlappingly transferred onto the intermediate transfer belt 41 at the same location.

According to the illustrative embodiment, as illustrated in FIG. 4, the intermediate transfer unit 13 including the intermediate transfer belt 41 is mounted in the enclosure 2 by moving the intermediate transfer unit 13 in the direction of arrow F1 and is detached by pulling out the intermediate transfer unit 13 in the opposite direction of the direction of F1.

The intermediate transfer belt 41 is formed of a plurality of layers, more specifically a base layer on which one or more coating layers are deposited. The base layer may be formed of relatively inelastic material. The base layer is then coated with a relatively smooth coating layer. The material of the base layer includes, but is not limited to, fluororesin, PVDF sheet, and polyimide resin. The material of the coating layer constituting the surface layer includes, but is not limited to, fluororesin or the like, or any other suitably smooth material.

The toner cartridges 14Y, 14M, 14C, and 14K store toner of yellow, magenta, cyan, and black, respectively, and are disposed in the enclosure 2 at substantially the top thereof so as to supply different colors of toner to the respective developing devices of the image forming unit 12.

A predetermined amount of toner is supplied to the developing devices in the image forming unit 12 through a toner conveyance path, not illustrated, in accordance with control exerted by a controller, a control system, a control software, and so forth of a known technology.

It is to be noted that toners of yellow, magenta, cyan, and black in the toner cartridges 14Y, 14M, 14C, and 14K are of polymerized toner, for example.

In FIG. 4, the image forming apparatus 1 includes a cleaning unit 76, an openable portion 77, power supply devices 78 and 79, and a power source 80.

The cleaning unit 76 is configured to clean the intermediate transfer belt 41 of the intermediate transfer unit 13.

The openable portion 77 supports a secondary transfer roller 91 and a cleaning blade 92 that cleans the secondary transfer roller 91. The openable portion 77 opens and closes relative to the enclosure 2.

The power supply devices 78 and 79 serve as electrical contacts to supply electric power from the enclosure 2 to the intermediate transfer unit 13 including the intermediate transfer belt 41.

The power source 80 serves as a power source for the intermediate transfer unit 13 as well as each component of the image forming apparatus 1.

Although not illustrated, the image forming apparatus 1 includes a drive unit, a start button, a control panel, a controller to exert overall control of the operation of the image forming apparatus, and so forth.

The drive unit rotatably drives the photoreceptor drums 12Y, 12*m*, 12C, and 12K. The start button initializes the image forming operation when depressed. An operator directs operation of the image forming apparatus using the control panel.

The intermediate transfer unit 13 includes, in addition to the intermediate transfer belt 41, the primary transfer rollers 75Y, 75M, 75C, and 75K, each of which serves as a primary transfer bias roller, the drive roller 72 serving as a drive member around which the intermediate transfer belt 41 is wound, the stretch roller 74, the stretch roller 73 serving as a support roller, and a tension roller 81.

The intermediate transfer belt 41 is wound around and stretched by the drive roller 72, the stretch roller 74, and the stretch roller 73. The tension roller 81 contacts the intermediate transfer belt 41 at the outer surface thereof and exerts a predetermined amount of tension on the intermediate transfer belt 41.

The cleaning unit 76 for the intermediate transfer belt 41 is provided so as to face the intermediate transfer belt 41 opposite the stretch roller 74. The cleaning unit 76 includes a cleaning blade 86 and a housing 87. The cleaning blade 86 is provided inside the housing 87.

The cleaning blade 86 is provided so as to contact the intermediate transfer belt 41 opposite the stretch roller 74 and configured to remove foreign substances such as undesirable toner or residual toner remaining on the intermediate transfer belt 41.

The stretch roller 74, the stretch roller 73, and the tension roller 81 are driven rollers that rotate together with the intermediate transfer belt 41 driven by the drive roller 72.

The drive roller 72 is disposed at substantially the rear portion of the intermediate transfer unit 13 in the advancing direction into the enclosure 2.

The primary transfer rollers 75Y, 75M, 75C, and 75K press against the intermediate transfer belt 41 from the back side thereof, that is, the inner loop of the intermediate transfer belt 41, against the photoreceptor drums 12Y, 12M, 12C, and 12K, thereby forming primary transfer nips therebetween.

The primary transfer nips are formed at a stretched portion of the intermediate transfer belt 41 stretched between the stretch roller 74 and the stretch roller 73. In other words, the stretch roller 74 and the stretch roller 73 can reliably maintain the primary transfer nips.

Further, the tension roller 81 contacts the outer surface of the intermediate transfer belt 41 at a position downstream from the drive roller 72, yet in the vicinity of the drive roller 72. With this configuration, the intermediate transfer belt 41 occupies a relatively small portion of the enclosure 2 in the vertical direction thereof.

Application of a primary transfer bias produces a primary transfer electric field in each of the primary transfer nips between the photoreceptor drums 12Y, 12M, 12C, and 12K and the primary transfer rollers 75Y, 75M, 75C, and 75K. The primary transfer electric field and nip pressure together cause the toner images of yellow, magenta, cyan, and black formed on the photoreceptor drums 12Y, 12M, 12C, and 12K to be transferred onto the intermediate transfer belt 41 in a primary transfer operation.

The drive roller 72 is disposed facing the secondary transfer roller 91 across from the intermediate transfer belt 41, forming a secondary transfer portion therebetween. In addition to the tension roller 81, the stretch roller 74 also serves as a pressure member that exerts a proper tension for transfer on the intermediate transfer belt 41.

In the sheet feeder 10, a sheet bundle including a plurality of transfer sheets S is stored in the sheet cassette 50. The sheet feeder 10 is provided substantially below the exposure 11 at substantially the bottom portion of the enclosure 2. That is, the sheet feeder 10 constitutes a paper bank at substantially the bottom portion of the enclosure 2.

As illustrated in FIG. 4, the sheet feeder 10 includes the sheet feed roller 32 and a separation roller, not illustrated. The sheet feed roller 32 is pressed against the front surface of the top sheet stored in the sheet cassette 50 so as to pick up and feed the top sheet. The separation roller separates one of the transfer sheets S fed by the sheet feed roller 32 and transports one sheet at a time.

The sheet feed roller 32 rotates in a counterclockwise direction at a predetermined timing so as to feed the top sheet in the sheet feed cassette 50 to a pair of registration rollers 88 at a proper timing.

The transfer sheet S fed from the sheet feeder 10 is transported through a sheet transport path and arrives between the pair of the registration rollers 88 between which the transfer sheet S is sandwiched.

The secondary transfer roller 91 serving as a secondary transfer device is provided inside the openable portion 77 such that when the openable portion 77 is closed, the secondary transfer roller 91 faces the drive roller 72 and sandwiches the intermediate transfer belt 41 therebetween.

The secondary transfer roller 91 can also transport the transfer sheet S. The secondary transfer roller 91 transports the transfer sheet S to the fixing unit 8 in the direction of arrow E1 after the toner image is transferred onto the transfer sheet S.

It is to be noted that a belt member may be used as the secondary transfer device. Alternatively, the secondary transfer device may use a contactless charger.

The cleaning blade 92 illustrated in FIG. 4 serves as a cleaning device that cleans the secondary transfer roller 91 by contacting the secondary transfer roller 91 to remove foreign substances such as paper dust and toner adhered to the secondary transfer roller 91.

In FIG. 4, the drawable portion 77 includes a shaft 93 that serves as the rotation center of the drawable portion 77. The drawable portion 77 is configured to rotate about the shaft 93 relative to the enclosure 2 so that the drawable portion 77 can be opened and closed together with the secondary transfer roller 91 and the cleaning blade 92 relative to the enclosure 2.

As illustrated in FIG. 4, when the drawable portion 77 is opened relative to the enclosure 2, the intermediate transfer unit 13 or the transfer belt unit is mountable at the predetermined place in the enclosure 2.

Although not illustrated and a detailed description is omitted, with a known configuration, the intermediate transfer unit 13 can be separated from the enclosure 2 as necessary or upon maintenance. In other words, when the intermediate transfer unit 13 needs to be removed from the enclosure 2, the drawable portion 77 is opened relative to the enclosure 2 so that the inside the enclosure 2 is accessible.

The photoreceptor drums 12Y, 12M, 12C, and 12K, and the devices provided therearound have the same configuration as all the others, differing only in the color of toner employed. In other words, the primary transfer roller 75, a cleaning blade 102 serving as a cleaning device, a charge neutralizer 103 serving as a charge neutralize device, a charger 104 serving as an AC charging device, and a developing device 105 serving as a developing device using a two-component developer are provided around each of the photoreceptor drums 12Y, 12M, 12C, and 12K.

It is to be noted that illustration of mounting/detaching of the exposure unit 11 is omitted in FIG. 4 and is instead indicated by an arrow.

Figure 5:
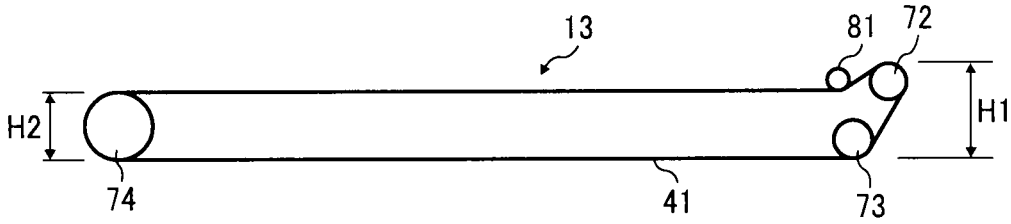
FIG. 5 is a schematic diagram conceptually illustrating the intermediate transfer unit of FIG. 4 according to an illustrative embodiment of the present invention.

Referring now to FIG. 5, there is provided a schematic diagram conceptually illustrating the intermediate transfer unit 13 according to the illustrative embodiment.

As described above, in the intermediate transfer unit 13, the intermediate transfer belt 41 is wound around the drive roller 72, the stretch roller 73, and the stretch roller 74. The tension roller 81 exerts a predetermined tension on the stretch roller 74 and the intermediate transfer belt 41.

According to the illustrative embodiment, as illustrated in FIG. 5, while the intermediate transfer belt 41 is wound around the rollers, a height H2 of the intermediate transfer unit 13, that is, the height of the left side of the intermediate transfer unit 13 from which the intermediate transfer unit 13 is mounted in the enclosure 2, is configured to be less than a height H1 of the opposite side of the intermediate transfer unit 13, that is, the right or rear side of the intermediate transfer unit 13 in the advancing direction.

Accordingly, the intermediate transfer unit 13 can be removed from the enclosure 2 from the side, the height of which is higher than H2. The intermediate transfer unit 13 can be removed from the enclosure 2 from the side (H1), the height of which is greater than that of the opposite side (H2). At the same time, the intermediate transfer unit 13 can be mounted in the enclosure 2 from the side, the height of which is less than the height (H1).

With this configuration, it is possible to reduce the space for mounting and detaching the intermediate transfer unit 13 in and from the enclosure 2 and to facilitate mounting and detachment of the intermediate transfer unit 13.

Figure 6:
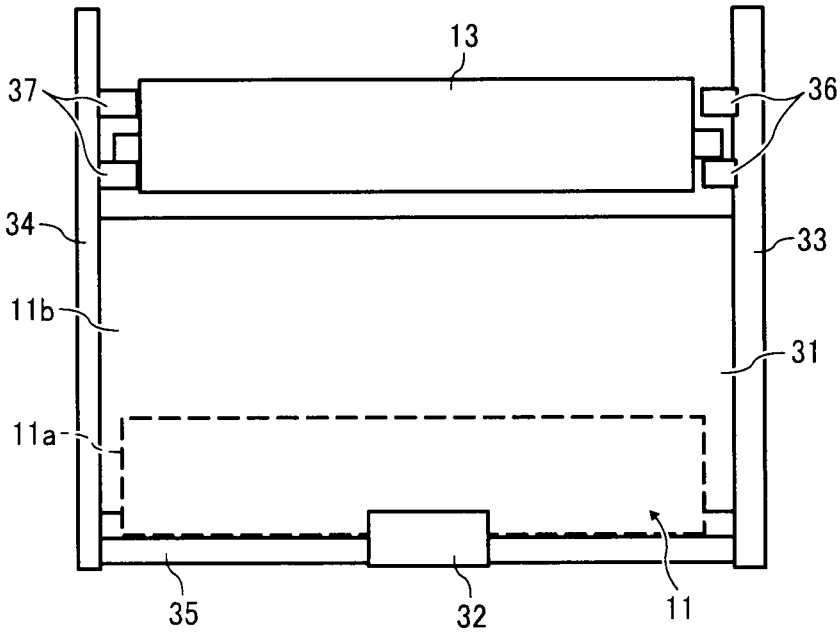
FIG. 6 is a side view conceptually illustrating the image forming apparatus of FIG. 1 as viewed from a direction indicated by arrow A in FIG. 1 according to an illustrative embodiment of the present invention.

Referring now to FIG. 6, there is provided a schematic diagram conceptually illustrating the relative positions of the enclosure 2 and the intermediate transfer unit 13 as viewed from the direction of arrow A in FIG. 1.

The enclosure 2 is formed by a front panel 34 provided with a front guide member 37 and a rear panel 33 provided with a rear guide member 36. The intermediate transfer unit 13 is slid along the front guide member 37 and the rear guide 36 member in a frontward direction so as to be mounted in or detached from the enclosure 2. Except for the portion of the intermediate transfer unit 13 that is mounted and detached, the intermediate transfer unit 13 is reinforced by stays.

In FIG. 6, an intermediate base 35 disposed substantially above the sheet feeder 10 guides the exposure unit 11 when the exposure unit 11 is detached from or mounted to the enclosure 2.

The exposure unit 11 includes a detachable portion 11*a* and a fixed portion 11*b*. The detachable portion 11*a* of the exposure unit 11 is detachable relative to the enclosure 2.

By contrast, the fixed portion 11*b* of the exposure unit 11 cannot be detached from the enclosure 2. The detachable portion 11*a* is detachably mountable from the rear side of FIG. 6 that is the equivalent of the left side in FIG. 1. The fixed portion 11*b* includes a stay 31 and another stay, not illustrated, to strengthen of the enclosure 2.

According to the illustrative embodiment, the sheet feed roller 32 can be disposed in substantially the vicinity of the very bottom of the mounting location of the detachable portion 11*a* of the exposure unit 11. Accordingly, as illustrated in FIG. 1, the height of the image forming apparatus 1 as a whole can be reduced by an amount indicated by H3 that is equivalent to the height of the sheet feed roller 32.

Further, according to the illustrative embodiment, the exposure unit 11 is configured to be detachably mountable from the opposite side of the enclosure 2 from which the intermediate transfer unit 13 is detachably mountable, thereby reducing the size of the opening at one side of the enclosure 2 when compared with a case in which both the exposure unit 11 and the intermediate transfer unit 13 are mounted or dismounted from the same side.

According to the illustrative embodiment, a relatively small opening is provided to each of the two opposing surfaces of the enclosure 2 so that the length of frame members that form the opening can be reduced, thereby enhancing the mechanical strength of the enclosure 2.

Figure 7:
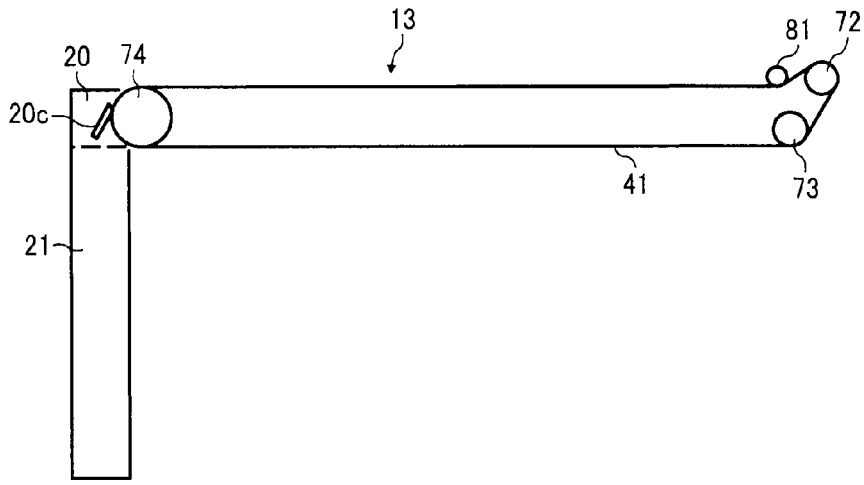
FIG. 7 is a schematic cross-sectional view illustrating another example of a cleaning unit according to an illustrative embodiment of the present invention.

Referring now to FIG. 7, there is provided a cross-sectional view conceptually illustrating another embodiment of the cleaning unit that can be employed in the intermediate transfer unit 13.

In FIG. 7, the cleaning unit includes a cleaning device 20 and a waste toner tank 21. The cleaning device 20 includes a cleaning blade 20*c* that removes the residual toner remaining on the outer surface of the intermediate transfer belt 41 opposite the stretch roller 74 and discharges the residual toner to the waste toner tank 21.

Although a detailed illustration of the waste toner tank 21 is not provided in FIG. 7, the waste toner tank 21 has a vertically elongated cylindrical shape having a height greater than a diameter in a width direction.

The intermediate transfer unit 13 can be separated from the cleaning device 20. The cleaning device 20 can be separated from the waste toner tank 21. Accordingly, when the intermediate transfer unit 13 is pulled out, the cleaning device 20 is pulled out with it. However, the waste toner tank 21 remains inside the enclosure 2.

Further, after the exposure unit 11 is pulled out, the operator may perform maintenance from the opening of the enclosure 2 from which the exposure unit 11 has been removed, or the operator may discard the waste toner inside.

As illustrated in FIG. 7, since the waste toner tank 21 is a substantially vertically elongated cylinder, the waste toner tank can be extendedly disposed in the vicinity of the upper portion of the exposure unit 11.

When the waste toner tank 21 is disposed extending downward, the capacity of the waste toner tank 21 can be increased, and further, the waste toner can be accumulated and packed inside the waste toner tank 21 by gravity so that the volume can be reduced.

Alternatively, the waste toner tank 21 alone may be configured to be removable from the enclosure 2 after the exposure 11 is pulled out.

Figure 8:
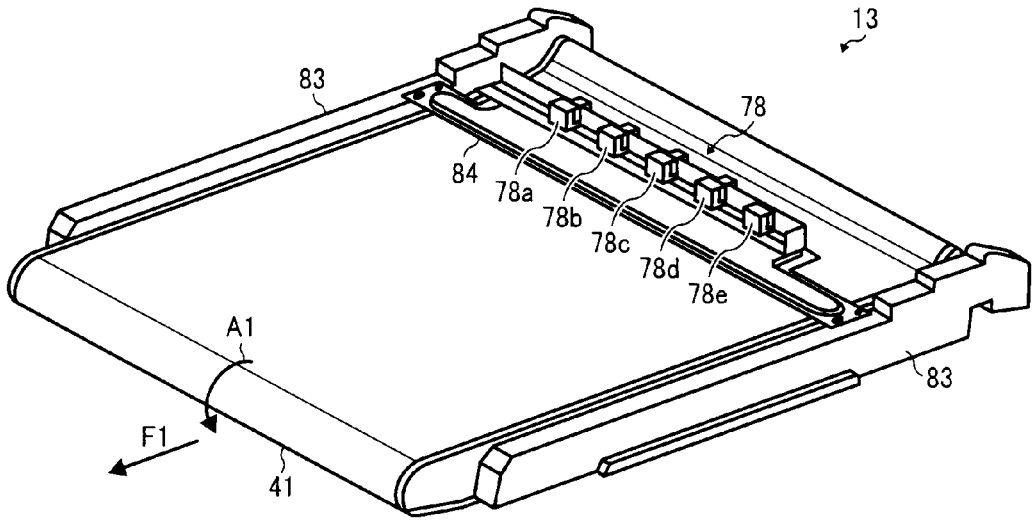
FIG. 8 is a perspective view illustrating the intermediate transfer unit according to an illustrative embodiment of the present invention.

Referring now to FIG. 8, there is provided a perspective view illustrating the above-described intermediate transfer unit 13 according to the illustrative embodiment.

As illustrated in FIG. 8, the intermediate transfer unit 13 includes a pair of frames 83 and a connecting member 84.

It is to be noted that, in FIG. 8, illustration of the drive roller 72, the stretch roller 73, the stretch roller 74, and the tension roller 81 are omitted.

The frames 83 are provided at both sides of the intermediate transfer belt 41 and configured to guide the transfer belt unit when the intermediate transfer unit 13 is dismounted from or mounted to the enclosure 2.

The connecting member 84 is provided between the frames 83 so as to connect the frames 83. The connecting member 84 includes the power supply devices 78*a*, 78*b*, 78*c*, 78*d*, and 78*e* that are supplied with charge from the enclosure 2 when the intermediate transfer unit 13 is mounted to the enclosure 2. The power supply devices 78*a*, 78*b*, 78*c*, 78*d*, and 78*e* are illustrated as 78 in FIG. 4.

As described above, the intermediate transfer unit 13 is mounted in the enclosure 2 by moving the intermediate transfer unit 13 in the direction of arrow F1 in FIG. 8. As the intermediate transfer unit 13 is mounted in the enclosure 2, the frames 83 are slid along guide rails, not illustrated, provided to the enclosure 2 in the direction of arrow F1, thereby guiding the intermediate transfer unit 13.

The power supply devices 78*a*, 78*b*, 78*c*, 78*d*, and 78*e* are integrally provided to the intermediate transfer unit 13. When the intermediate transfer unit 13 is mounted at a predetermined position in the enclosure 2, the power supply device 79 of FIG. 4 contacts and electrically connects to the power supply devices 78*a* through 78*e*, thereby supplying the intermediate transfer unit 13 with electric power.

It is to be noted that the power supply devices 78*a* through 78*e* are provided substantially above the photoreceptor drums 12Y, 12M, 12C, and 12K across from the intermediate transfer belt 41, substantially near the outside of the enclosure 2.

According to the illustrative embodiment, the consumables that need to be replaced frequently are provided at substantially the front side of the image forming apparatus 1, thereby facilitating maintenance.

By contrast, for those components that are less frequently replaced or have a similar product life as the image forming apparatus 1, operations including maintenance or the like can be performed by the operator at the sides of the image forming apparatus so as to prevent erroneous operation by the operator.

According to the illustrative embodiment, the exposure unit 11 and the intermediate transfer unit 13 are configured to be pulled out from different sides, that is, from the left and the right sides, respectively, of the enclosure 2.

With this configuration, the components are prevented from interfering with each other, and the height of the image forming apparatus can be reduced.

Further, the size of the opening of the enclosure 2 from which the operator performs maintenance or the like can be configured in accordance with the size of the components subjected to maintenance, thereby reducing the size of the opening and thus enhancing the strength of the enclosure 2.

According to the illustrative embodiment, the components are disposed such that a reduction in height of the components disposed on one another is compensated in the width direction, thereby reducing the height of the image forming apparatus as a whole.

According to the illustrative embodiment, the components including the intermediate transfer unit are mounted from the side, the height of which is less than that of the rear portion of the components in the mounting direction thereof, and detached from the side, the height of which is greater than that of the front side, thereby reducing the mounting space in the enclosure and facilitating mounting and dismounting of the components.

According to the illustrative embodiment, the cleaning unit is provided to the side portion of the intermediate transfer unit, thereby eliminating an extra space both above and below the intermediate transfer unit and thus reducing the height of the image forming apparatus.

Further, with this configuration, maintenance and/or replacement of parts of the cleaning unit, the product life of which is relatively shorter than the intermediate transfer unit, can be performed without removing the intermediate transfer unit from the enclosure 2, thereby facilitating the operation.

According to the illustrative embodiment, the waste toner tank has a vertically elongated cylinder shape. Accordingly, the waste toner is packed in the waste toner tank by gravity and the volume of the waste toner can be reduced.

Further, the waste toner tank is provided extending to the exposure unit so that the capacity of the waste toner tank can be increased.

Still further, the waste toner tank can be separated from the cleaning unit so that the waste toner tank and the cleaning unit having different product life can be replaced at different timing.

According to the illustrative embodiment, the waste toner tank can be repaired or replaced from the opening from which the exposure unit is mounted or dismounted, thereby eliminating an extra opening dedicated for the waste toner tank and thus enhancing strength of the enclosure.

Furthermore, elements and/or features of different illustrative embodiments may be combined with each other and/or substituted for each other within the scope of this disclosure and appended claims. The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An image forming apparatus for forming an image, comprising:

an enclosure including a plurality of vertical columns that extend from a base portion of the image forming apparatus to support a scanner at a top portion of the image forming apparatus, a first opening provided at a first side of the image forming apparatus, a second opening provided at a second side of the image forming apparatus, the second side extending from a first end of the first side, and a third opening provided at a third side of the image forming apparatus, the third side extending from a second end of the first side such that the second side and the third side are opposite each other;

an image forming unit including an image bearing member configured to bear a latent image on a surface thereof the image forming unit being detachably mountable through the first opening of the enclosure;

an exposure unit configured to expose the image bearing member in the image forming unit to form the latent image on the surface of the image bearing member, the exposure unit being detachably mountable through the second opening of the enclosure, which is opposite the third opening of the enclosure;

a developing device configured to develop the latent image with toner to form a toner image on the image bearing member;

an intermediate transfer unit configured to transfer the toner image on the image bearing member, the intermediate transfer unit being detachably mountable through the third opening of the enclosure;

a toner supply unit including a toner cartridge replaceable through the first opening of the enclosure, the toner supply unit being configured to supply toner to the developing device; and a sheet feed unit configured to be supplied with a transfer sheet through the first opening of the enclosure.

2. The image forming apparatus according to claim 1, wherein a height of a leading side of the intermediate transfer unit in an advancing direction thereof to the enclosure is substantially less than a height of a rear side of the intermediate transfer unit.

3. The image forming apparatus according to claim 2, wherein the intermediate transfer unit includes an endless intermediate transfer belt, a plurality of rollers around which the intermediate transfer belt is wound, and a tension roller, wherein the tension roller is configured to contact an outer surface of the intermediate transfer belt at substantially a rear portion thereof in the advancing direction so as to exert a predetermined tension on the intermediate transfer belt, and the tension roller is disposed in a vicinity of one of the plurality of rollers at substantially an end of the intermediate transfer belt in the advancing direction thereof and disposed lower than the one of the plurality of rollers at substantially the end of the intermediate transfer belt.

4. The image forming apparatus according to claim 3, wherein the intermediate transfer unit includes a cleaning unit configured to collect waste toner removed from the intermediate transfer belt and is disposed at substantially the leading side of the intermediate transfer unit in the advancing direction thereof so as to allow operations including maintenance to be performed on the cleaning unit via the second opening after the exposure unit is removed from the second opening.

5. The image forming apparatus according to claim 4, wherein the cleaning unit includes a waste toner tank having a vertically elongated cylindrical shape configured to store the waste toner collected from the intermediate transfer belt and is disposed at substantially a lower portion of the cleaning unit.

6. The image forming apparatus according to claim 5, wherein the waste toner tank is detachable from the cleaning unit.

7. The image forming apparatus according to claim 6, wherein the waste toner tank is disposed extending to a vicinity of an upper portion of the exposure unit so as to increase a capacity of the waste toner tank.

8. The image forming apparatus according to claim 1, wherein the intermediate transfer unit includes a cleaning unit configured to collect waste toner removed from an intermediate transfer belt and is disposed at substantially a leading side of the intermediate transfer unit in an advancing direction thereof so as to allow operations including maintenance to be performed relative to the cleaning unit via the second opening after the exposure unit is removed from the second opening.

9. The image forming apparatus according to claim 8, wherein the cleaning unit includes a waste toner tank having a vertically elongated cylindrical shape configured to store the waste toner collected from the intermediate transfer belt and is disposed at substantially a lower portion of the cleaning unit.

10. The image forming apparatus according to claim 9, wherein the waste toner tank is detachable from the cleaning unit.

11. The image forming apparatus according to claim 10, wherein the exposure unit includes a detachable portion that is detachably mountable relative to the enclosure and a fixed portion that is not detachable from the enclosure.

12. The image forming apparatus according to claim 11, wherein the sheet feed unit includes a sheet feed roller disposed in a vicinity of a bottom of the detachable portion of the exposure unit.

13. The image forming apparatus according to claim 1, wherein the exposure unit includes a detachable portion that is detachably mountable relative to the enclosure and a fixed portion that is not detachable from the enclosure.

14. The image forming apparatus according to claim 13, wherein the sheet feed unit includes a sheet feed roller disposed in a vicinity of a bottom of the detachable portion of the exposure unit.

15. The image forming apparatus according to claim 14, wherein a height of a leading side of the intermediate transfer unit in an advancing direction thereof to the enclosure is less than a height of a rear side of the intermediate transfer unit.

16. The image forming apparatus according to claim 15, wherein the intermediate transfer unit includes an endless intermediate transfer belt, a plurality of rollers around which the intermediate transfer belt is wound, and a tension roller, wherein the tension roller is configured to contact an outer surface of the intermediate transfer belt at substantially a rear portion thereof in the advancing direction so as to exert a predetermined tension on the intermediate transfer belt, and the tension roller is disposed in a vicinity of one of the plurality of rollers at substantially an end of the intermediate transfer belt in the advancing direction thereof and disposed lower than the one of the plurality of rollers at substantially the end of the intermediate transfer belt.

17. The image forming apparatus according to claim 16, wherein the intermediate transfer unit includes a cleaning unit configured to collect waste toner removed from the intermediate transfer belt and is disposed at substantially the leading side of the intermediate transfer unit in the advancing direction thereof so as to allow operations including maintenance to be performed on the cleaning unit via the second opening after the exposure unit is removed from the second opening.

18. The image forming apparatus according to claim 17, wherein the cleaning unit includes a waste toner tank having a vertically elongated cylindrical shape configured to store the waste toner collected from the intermediate transfer belt and is disposed at substantially a lower portion of the cleaning unit.

19. The image forming apparatus according to claim 18, wherein the waste toner tank is detachable from the cleaning unit.

20. The image forming apparatus according to claim 19, wherein the waste toner tank is disposed extending to a vicinity of an upper portion of the exposure unit so as to increase a capacity of the waste toner tank.

* * * * *